US011760097B2

(12) United States Patent
Han et al.

(10) Patent No.: US 11,760,097 B2
(45) Date of Patent: Sep. 19, 2023

(54) INKJET CIRCULATION APPARATUS

(71) Applicant: Samsung Display Co., LTD., Yongin-si (KR)

(72) Inventors: Kang Soo Han, Seoul (KR); Seon Uk Lee, Seongnam-si (KR); Kanguk Kim, Hwaseong-si (KR); Ho-Yong Shin, Suwon-si (KR); Cheho Lim, Cheonan-si (KR); Donchan Cho, Seongnam-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 207 days.

(21) Appl. No.: 17/407,431

(22) Filed: Aug. 20, 2021

(65) Prior Publication Data

US 2022/0153031 A1 May 19, 2022

(30) Foreign Application Priority Data

Nov. 13, 2020 (KR) ..... 10-2020-0151513

(51) Int. Cl.
*B41J 2/17* (2006.01)

(52) U.S. Cl.
CPC ..... *B41J 2/1721* (2013.01)

(58) Field of Classification Search
CPC ..... B41J 2/18; B41J 2/1721; B41J 2/175
See application file for complete search history.

(56) References Cited

U.S. PATENT DOCUMENTS

| | | | | |
|---|---|---|---|---|
| 8,714,696 | B2 * | 5/2014 | Tanaka | B41J 2/175 347/30 |
| 10,611,167 | B2 * | 4/2020 | Yamagishi | B41J 2/17513 |
| 11,267,248 | B2 * | 3/2022 | Komatsu | B41J 2/19 |

FOREIGN PATENT DOCUMENTS

| | | |
|---|---|---|
| JP | 2001-171148 | 6/2001 |
| JP | 2010-142971 | 7/2010 |
| KR | 10-0504796 | 7/2005 |
| KR | 10-1212086 | 12/2012 |
| KR | 10-2013-0136404 | 12/2013 |

* cited by examiner

*Primary Examiner* — An H Do
(74) *Attorney, Agent, or Firm* — KILE PARK REED & HOUTTEMAN PLLC

(57) ABSTRACT

An inkjet circulation apparatus may include at least one inkjet printer including a supplier into which an ink is injected, a discharger connected to the supplier, and discharging the ink injected from the supplier, and a drain connected to the discharger and the supplier, and injecting the ink in the discharger into the supplier, at least one collector capable of containing an inert gas and the ink discharged from the discharger, and a contact member sealing between the discharger and the collector.

20 Claims, 7 Drawing Sheets

INKJET CIRCULATION APPARATUS

CROSS-REFERENCE TO RELATED APPLICATION

This application claims priority to and the benefit of Korean Patent Application No. 10-2020-0151513 under 35 U.S.C. § 119, filed in the Korean Intellectual Property Office (KIPO) on Nov. 13, 2020, which is hereby incorporated by reference for all purposes as if fully set forth herein.

BACKGROUND

1. Technical Field

Embodiments relate generally to an inkjet circulation apparatus. More specifically, embodiments of the disclosure relate to an inkjet circulation apparatus including an inkjet printer.

2. Description of the Related Art

With a development of information technology, a market for a display device, which is a connection medium between users and information, is growing. Accordingly, a use of a flat panel display such as an organic light emitting display, a liquid crystal display, etc. is increasing.

Recently, a display device including a color conversion pattern using semiconductor nanocrystals has been proposed in order to implement a display device having excellent color reproduction and high luminance.

Meanwhile, the color conversion pattern may be formed using an inkjet printer apparatus. The inkjet printer apparatus may apply an ink in a drop on demand ("DOD") method. A use of the inkjet printer apparatus has advantages of simplifying a process of manufacturing a display device and reducing cost. Therefore, in recent years, a technique of forming the color conversion pattern using the inkjet printer apparatus rather than a vapor deposition has been developed.

Meanwhile, the inkjet printer apparatus may discharge an ink to a non-printing area and a printing area. However, the ink discharged to the non-printing area may be contaminated or deteriorated by contact with external air. Accordingly, in case that the ink discharged to the non-printing area is recycled, a quality of the ink may be deteriorated.

SUMMARY

Embodiments provide an inkjet circulation apparatus including an inkjet printer.

According to embodiments, an inkjet circulation apparatus may include at least one inkjet printer including a supplier into which an ink is injected, a discharger connected to the supplier and discharging the ink injected from the supplier, and a drain connected to the discharger and the supplier and injecting the ink in the discharger into the supplier, at least one collector capable of containing an inert gas and the ink discharged from the discharger, and a contact member sealing between the discharger and the collector.

In an embodiment, each of the at least one inkjet printer and the at least one collector may include a plurality of inkjet printers and a plurality of collectors, respectively.

In an embodiment, the inkjet circulation apparatus may further comprise a storage container connected to the collector and being capable of containing the inert gas and the ink injected from the collector.

In an embodiment, the storage container may include a stirrer for mixing the ink.

In an embodiment, the storage container may include a first outlet through which the inert gas is discharged, and a second outlet through which the ink in the storage container is discharged.

In an embodiment, the second outlet may be connected to the supplier of the inkjet printer and inject the ink into the supplier.

In an embodiment, the inkjet circulation apparatus may further comprise a mixing container connected to the second outlet of the storage container, and being capable of containing the inert gas and the ink injected from the storage container.

In an embodiment, the mixing container may include a stirrer for mixing the ink.

In an embodiment, the mixing container may include a third outlet through which the inert gas is discharged, a fourth outlet through which the ink in the mixing container is discharged, and at least one pipe for injecting an additive into the mixing container.

In an embodiment, the at least one pipe may include a plurality of pipes.

In an embodiment, the additive may include at least one of a dispersant and a surfactant.

In an embodiment, the fourth outlet of the mixing container may be connected to the supplier of the inkjet printer and inject the ink into the supplier.

In an embodiment, the inkjet circulation apparatus may further comprise a recycling apparatus connected to the fourth outlet of the mixing container and discharging the ink discharged from the fourth outlet.

In an embodiment, the recycling apparatus may include a recycling supplier connected to the fourth outlet of the mixing container, the ink discharged from the mixing container being injected into the recycling supplier, a recycling discharger connected to the recycling supplier and discharging the ink injected from the recycling supplier, and a recycling drain connected to the recycling supplier and the recycling discharger, and injecting the ink in the recycling discharger to inject the ink to the recycling supplier.

In an embodiment, the recycling discharger may include an inkjet print head.

In an embodiment, the inkjet print head may be a thermal inkjet print head or a piezo inkjet print head.

In an embodiment, the recycling discharger may include at least one of a jet nozzle, a syringe, and a slit.

In an embodiment, the inert gas may include at least one of nitrogen ($N_2$), argon (Ar), helium (He), and neon (Ne)

In an embodiment, the contact member may include a soft material.

In an embodiment, the contact member may include at least one of a silicone and a polymer material.

In the inkjet circulation apparatus according to an embodiment, in a non-printing area, an ink inside a collector may be prevented from contacting an outside by using a contact member that seals between a discharger and a collector of an inkjet printer. Accordingly, contamination and deterioration of the ink discharged to the non-printing area may be prevented. The ink discharged to the non-printing area may be recycled to manufacture a display panel or repair a damaged a display panel.

BRIEF DESCRIPTION OF THE DRAWINGS

Illustrative, non-limiting embodiments will be more clearly understood from the following detailed description in conjunction with the accompanying drawings.

DETAILED DESCRIPTION OF THE EMBODIMENTS

Figure 1:
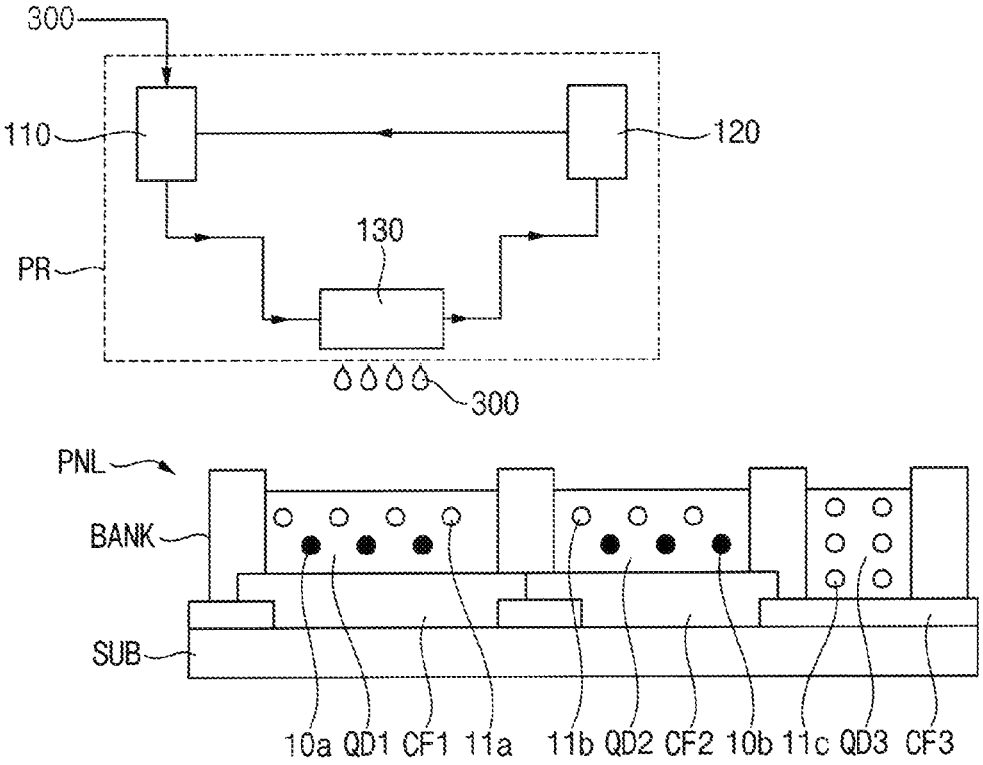
FIG. 1 is a diagram schematically illustrating an inkjet printer in a printing area according to an embodiment.

Hereinafter, embodiments of the disclosure will be explained in detail with reference to the accompanying drawings. The same reference numerals are used for the same components in the drawings, and redundant descriptions of the same components will be omitted.

The phrase "at least one of" is intended to include the meaning of "at least one selected from the group of" for the purpose of its meaning and interpretation. For example, "at least one of A and B" may be understood to mean "A, B, or A and B."

Unless otherwise defined or implied herein, all terms (including technical and scientific terms) used herein have the same meaning as commonly understood by those skilled in the art to which this disclosure pertains. It will be further understood that terms, such as those defined in commonly used dictionaries, should be interpreted as having a meaning that is consistent with their meaning in the context of the relevant art and the disclosure, and should not be interpreted in an ideal or excessively formal sense unless clearly so defined herein.

FIG. 1 is a diagram schematically illustrating an inkjet printer in a printing area according to an embodiment. For example, FIG. 1 may show an inkjet printer PR and a display panel PNL.

Referring to FIG. 1, the inkjet printer PR may include a supplier 110, a drain 120, and a discharger 130.

Ink 300 stored in an ink reservoir may be injected into the supplier 110. For example, the ink 300 may include at least one of red ink, green ink, and white ink. The ink 300 in the supplier 110 may be injected into the discharger 130. A portion of the ink 300 in the discharger 130 may be injected into the drain 120. In other words, the ink 300 injected from the ink reservoir into the supplier 110 may be circulated through the supplier 110, the discharger 130, and the drain 120. In an embodiment, the discharger 130 may include an inkjet print head. For example, the inkjet print head may be a thermal inkjet print head or a piezo inkjet print head. The ink 300 in the discharger 130 may be discharged to an outside through the inkjet printing head.

The display panel PNL may include a member (or substrate) SUB, first to third curling filters CF1, CF2, and CF3, a bank layer BANK, first and second color conversion patterns QD1 and QD2, a light transmission pattern QD3, or the like.

The first color conversion pattern QD1 may include a red phosphor. The red phosphor may include at least one of (Ca, Sr, Ba)S, $(Ca, Sr, Ba)_2Si_5N_8$, $(CaAlSiN_3)$, $CaMoO_4$, and $Eu_2Si_5N_8$. The first color conversion pattern QD1 may include a quantum dot 10*a*. The first color conversion pattern QD1 may further include a scattering body 11*a*. The scattering body 11*a* may be a metal oxide particle or an organic particle.

The second color conversion pattern QD2 may include a green phosphor. The green phosphor may include at least one of yttrium aluminum garnet ("YAG"), $(Ca, Sr, Ba)_2SiO_4$, $SrGa_2S_4$, barium magnesium aluminate ("BAM"), alpha sialon (α-SiAlON), beta sialon (β-SiAlON), $Ca_3Sc_2Si_3O_{12}$, $Tb_3Al_5O_{12}$, $BaSiO_4$, CaAlSiON, and $(Sr_{1-x}Ba_x)Si_2O_2N_2$. The second color conversion pattern QD2 may include a quantum dot 10*b*. The second color conversion pattern QD2 may further include a scattering body 11*b*. The scattering body 11*b* included in the second color conversion pattern QD2 may be substantially identical or similar to the scattering body 11*a* included in the first color conversion pattern QD1.

The light transmission pattern QD3 may include a transparent polymer material. The light transmission pattern QD3 may include a scattering body 11*c*. The scattering body 11*c* included in the light transmission pattern QD3 may be substantially identical or similar to the scattering body 11*a* included in the first color conversion pattern QD1 and the scattering body 11*b* included in the second color conversion pattern QD2.

The first color conversion pattern QD1, the second color conversion pattern QD2, and the light transmission pattern QD3 may be formed using the inkjet printer PR. In other words, the inkjet printer PR moves to a location where the display panel PNL is located, and the first color conversion pattern QD1, the second color conversion pattern QD2, and the light transmission pattern QD3 of the display panel PNL may be formed. For example, the red ink may be discharged from the discharger 130 of the inkjet printer PR to form the first color conversion pattern QD1, the green ink may be discharged from the discharger 130 of the inkjet printer PR to form the second color conversion pattern QD2, and the white ink may be discharged from the discharger 130 of the inkjet printer PR to form the light transmission pattern QD3.

The inkjet printer PR may discharge the ink 300 into a printing area and a non-printing area. The printing area may be defined as an area in which the ink 300 is discharged to manufacture the display panel PNL. The non-printing area may be defined as an area in which the ink 300 is discharged to prevent deterioration of the discharger 130 included in the inkjet printer PR before the display panel PNL is manufactured.

However, in the prior art, since a large amount of the ink 300 is discharged to the non-printing area, a large amount of the ink 300 is discarded. The ink 300 collected in the non-printing area was contaminated by contact with external air, and recycling the ink 300 was difficult.

Figure 2:
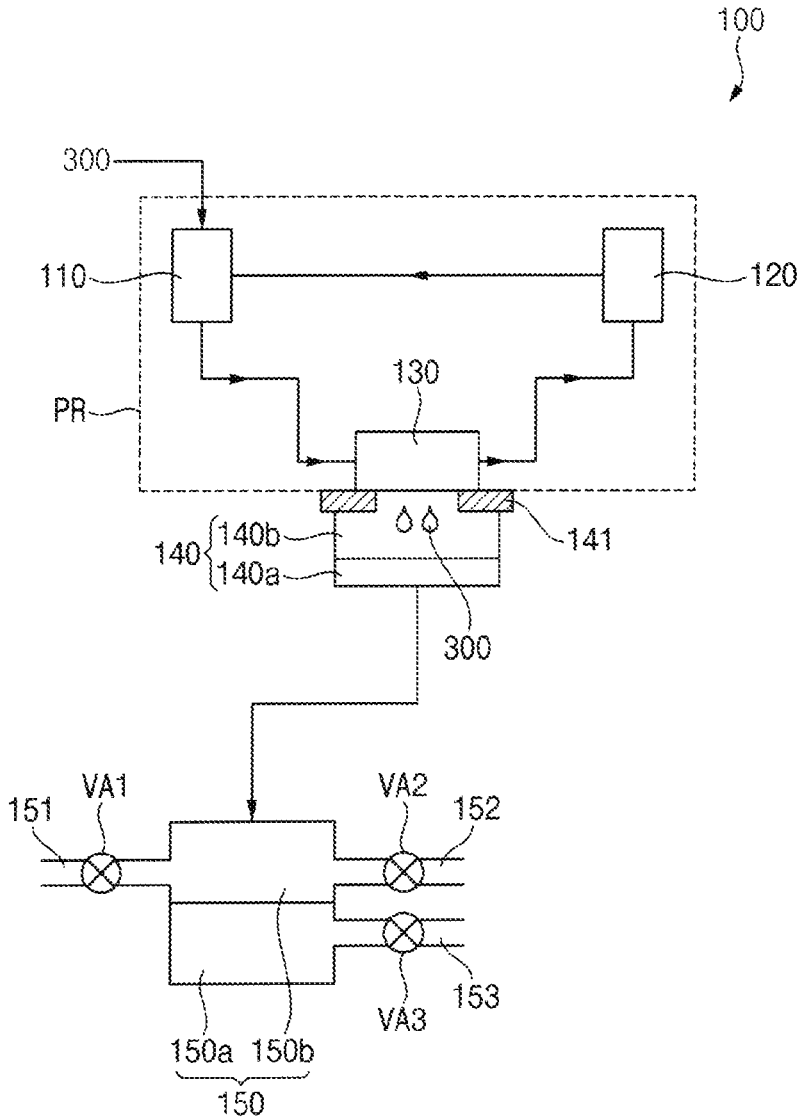
FIG. 2 is a diagram schematically illustrating an inkjet circulation apparatus in a non-printing area according to an embodiment.

FIG. 2 is a diagram schematically illustrating an inkjet circulation apparatus in a non-printing area according to an embodiment.

Referring to FIG. 2, the inkjet circulation apparatus 100 capable of recycling the ink 300 discharged to the non-printing area may include the inkjet printer PR, a collector 140, a storage container 150, a contact member 141, or the like. The inkjet printer PR may include a supplier 110, a drain 120, and a discharger 130. However, the inkjet printer PR may be substantially identical or similar to the inkjet printer PR shown in FIG. 1. Hereinafter, a rest of the configuration except for the inkjet printer PR will be mainly described.

As shown in FIG. 1, the inkjet printer PR may discharge the ink 300 through the discharger 130 to manufacture (or form) the display panel PNL by moving to a location where the display panel PNL is located. However, before moving to the location where the display panel PNL is located, the inkjet printer PR may discharge the ink 300 to the collector 140 by moving to a location where the collector 140 is located in order to prevent deterioration of the discharger 130.

In an embodiment, the contact member 141 may completely seal between the discharger 130 and the collector 140 of the inkjet printer PR. For example, the contact member 141 may be disposed between the discharger 130 and the collector 140 and may contact the discharger 130 and the collector 140.

In an embodiment, the contact member 141 may include a soft material. For example, the contact member 141 may include at least one of a silicone and a polymer material. For example, the polymer material may include polyethylene terephthalate (PET), polyethylene (PE), polypropylene (PP), polyamide (PA), polyimide (PI), polytetrafluoroethylene (PTFE), and the like.

The collector 140 may be divided into a first collector 140*a* and a second collector 140*b*. In an embodiment, the first collector 140*a* may be defined as a space in which the ink 300 discharged from the discharger 130 is collected, and the second collector 140*b* may be defined as a space filled with an inert gas. For example, the inert gas may include at least one of nitrogen ($N_2$), argon (Ar), helium (He), and neon (Ne). Accordingly, due to the inert gas, the ink 300 in the collector 140 is blocked from contacting external air, and thus contamination or deterioration of the ink 300 may be prevented.

In an embodiment, the storage container 150 may be connected to the collector 140. Accordingly, the ink 300 in the second collector 140*b* of the collector 140 may be injected into the storage container 150.

The storage container 150 may be divided into a first storage container 150*a* and a second storage container 150*b*. In an embodiment, the first storage container 150*a* may be defined as a space filled with the ink 300 injected from the collector 140, and the second storage container 150*b* may be defined as a space filled with an inert gas injected through a gas inlet 151. For example, the inert gas may include at least one of nitrogen ($N_2$), argon (Ar), helium (He), and neon (Ne). Accordingly, due to the inert gas, the ink 300 in the storage container 150 is blocked from contacting external air, and thus contamination or deterioration of the ink 300 may be prevented.

The storage container 150 may include the gas inlet 151, a first outlet 152 and a second outlet 153. The inert gas may be injected into the storage container 150 through the gas inlet 151, the inert gas in the storage container 150 may be discharged through the first outlet 152, and the ink 300 in the storage container 150 may be discharge through the second outlet 153.

A first valve VA1 may be disposed in the gas inlet 151, a second valve VA2 may be disposed in the first outlet 152, and a third valve VA3 may be disposed in the second outlet 153. Each of the valves VA1, VA2, and VA3 may perform a function of controlling the discharge of a material (e.g., a fluid, the inert gas, the ink 300, etc.) in each of the gas inlet 151, the first outlet 152, and the second outlet 153.

In an embodiment, the storage container 150 may include a stirrer. The stirrer may perform a function of evenly mixing the ink 300 in the storage container 150.

Figure 3:
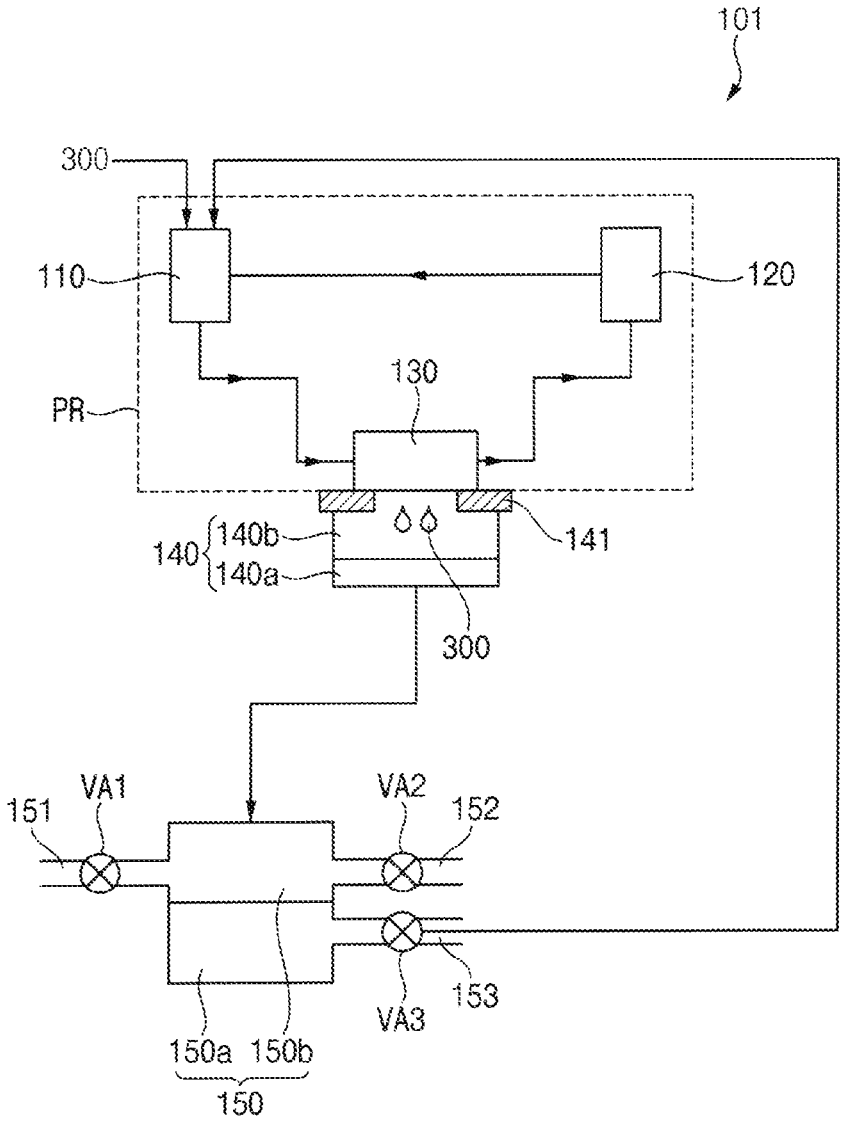
FIG. 3 is a diagram schematically illustrating an inkjet circulation apparatus in a non-printing area according to another embodiment.

FIG. 3 is a diagram schematically illustrating an inkjet circulation apparatus in a non-printing area according to another embodiment.

Referring to FIG. 3, in the inkjet circulation apparatus 101 according to an embodiment, the second outlet 153 of the storage container 150 may be connected to the supplier 110 of the inkjet printer PR. In other words, the ink 300 in the storage container 150 may be injected into the supplier 110 of the inkjet printer PR through the second outlet 153. Accordingly, the inkjet printer PR may recycle the newly injected ink 300 to manufacture a display panel PNL or repair a damaged display panel PNL.

Figure 4:
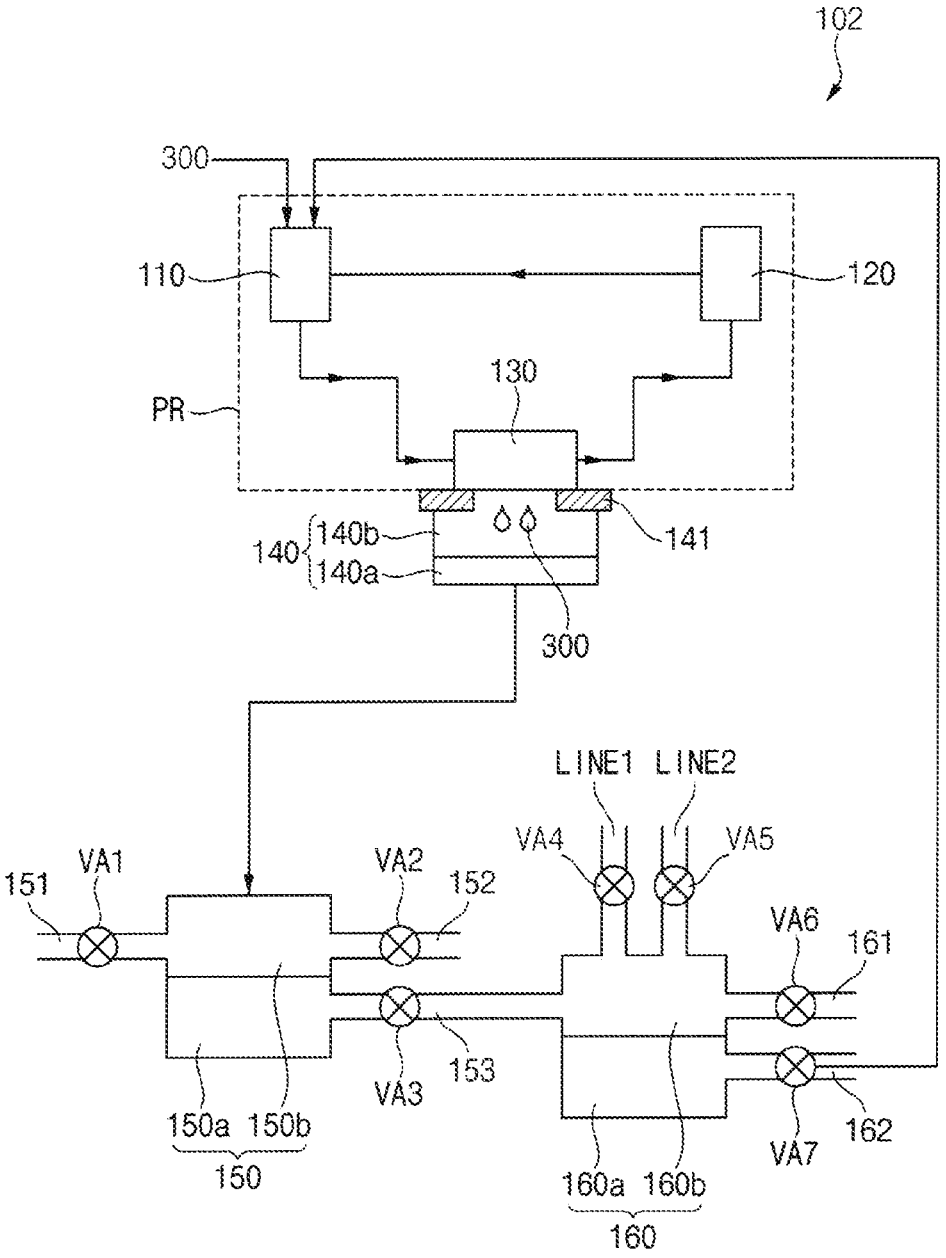
FIG. 4 is a diagram schematically illustrating an inkjet circulation apparatus in a non-printing area according to still another embodiment.

FIG. 4 is a diagram schematically illustrating an inkjet circulation apparatus in a non-printing area according to still another embodiment.

Referring to FIG. 4, the inkjet circulation apparatus 102 may include an inkjet printer PR, a collector 140, a storage container 150, a contact member 141, a mixing container 160, and the like. The inkjet printer PR may include a supplier 110, a drain 120, and a discharger 130. However, the inkjet circulation apparatus 102 may be substantially identical or similar to the inkjet circulation apparatus 101 shown in FIG. 3 except that the mixing container 160 is further included. Hereinafter, the mixing container 160 will be mainly described.

According to an embodiment, the mixing container 160 may be connected to the second outlet 153 of the storage container 150. In other words, the ink 300 in the storage container 150 may be injected into the mixing container 160 through the second outlet 153 of the storage container 150.

The mixing container 160 may be divided into a first mixing container 160*a* and a second mixing container 160*b*. In an embodiment, the first mixing container 160*a* may be defined as a space in which the ink 300 in the storage container 150 is injected through the second outlet 153, and the second mixing container 160*b* may be defined as a space filled with an inert gas. For example, the inert gas may include at least one of nitrogen ($N_2$), argon (Ar), helium (He), and neon (Ne). Accordingly, because of the inert gas, the ink 300 in the mixing container 160 is blocked from contacting external air, and thus contamination or deterioration of the ink 300 may be prevented.

The mixing container 160 may include a third outlet 161 and a fourth outlet 162. The inert gas in the mixing container 160 may be discharged through the third outlet 161, and the ink 300 in the mixing container 160 may be discharged through the fourth outlet 162.

In an embodiment, the mixing container 160 may include a first pipe LINE1 and a second pipe LINE2.

In an embodiment, an additive may be injected into the mixing container 160 through the first pipe LINE1 and the second pipe LINE2. For example, the additive may include at least one of a dispersant and a surfactant. For example, the dispersant may be injected through the first pipe LINE1, and the surfactant may be injected through the second pipe LINE2. As another example, the surfactant may be injected through the first pipe LINE1, and the dispersant may be injected through the second pipe LINE2. Accordingly, physical properties of the ink 300 in the mixing container 160 may be changed. For example, when a dispersant, a surfactant, etc. are injected into the mixing container 160 through the first pipe LINE1 and the second pipe LINE2, a viscosity of the ink 300 in the mixing container 160 may be changed.

A fourth valve VA4 may be disposed in the first pipe LINE1, a fifth valve VA5 may be disposed in the second pipe LINE2, a sixth valve VA6 may be disposed in the third outlet 161, and a seventh valve VA7 may be disposed in the fourth outlet 162. Each of the valves VA4, VA5, VA6, and VA7 may perform a function of controlling the discharge of a fluid (e.g., the inert gas, the ink 300, etc.) in the first pipe LINE1, the second pipe LINE2, the third outlet 161, and the fourth outlet 162, respectively.

In an embodiment, the mixing container 160 may include a stirrer. The stirrer may perform a function of evenly mixing the ink 300 in the mixing container 160.

In an embodiment, the fourth outlet 162 of the mixing container 160 may be connected to the supplier 110 of the inkjet printer PR. In other words, the ink 300 in the mixing container 160 may be injected into the supplier 110 of the inkjet printer PR through the fourth outlet 162 of the mixing container 160. Accordingly, the inkjet printer PR may recycle the newly injected ink 300 to manufacture a display panel PNL or repair a damaged display panel PNL.

Figure 5:
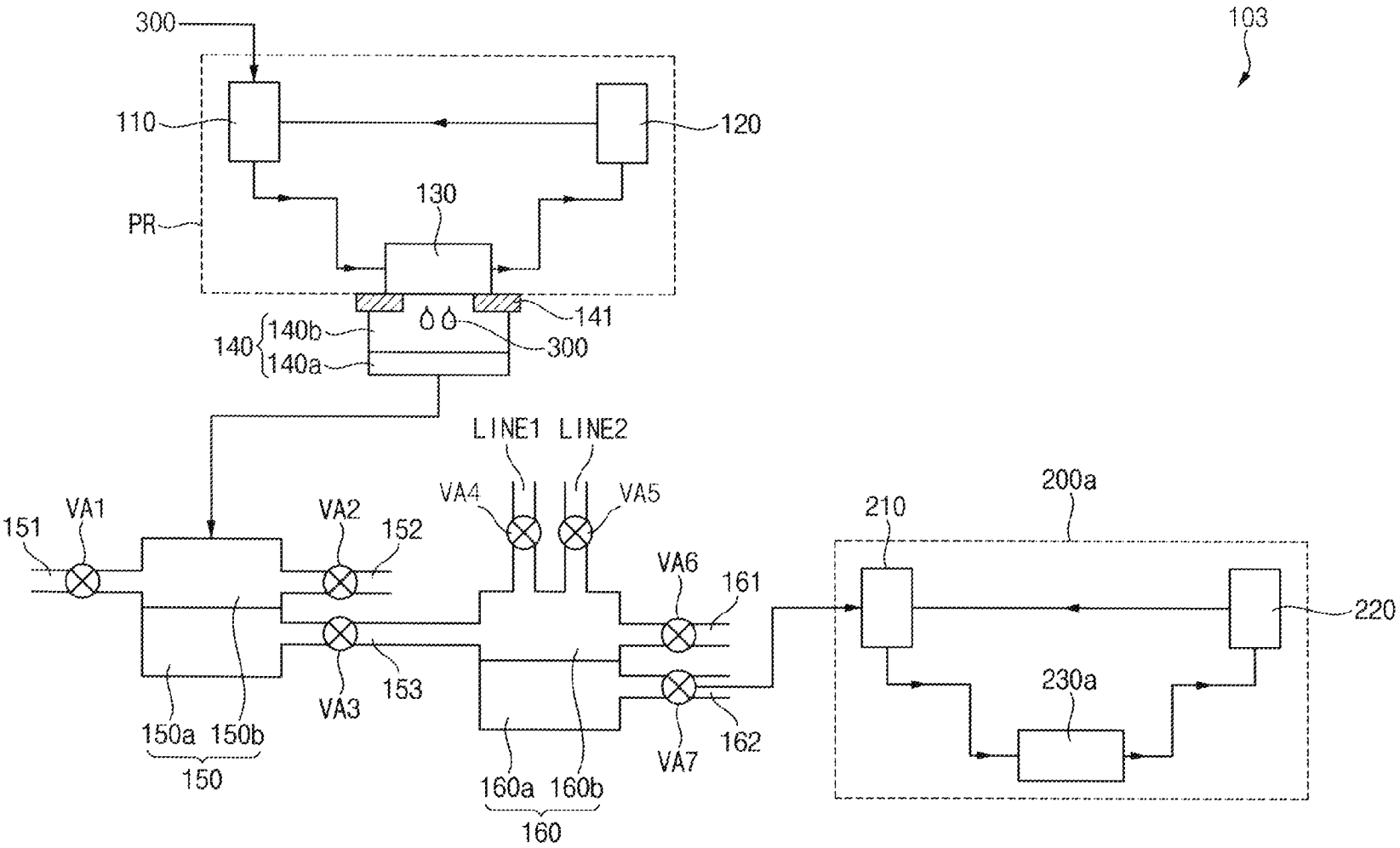
FIG. 5 is a diagram schematically illustrating an inkjet circulation apparatus in a non-printing area according to still another embodiment.

FIG. 5 is a diagram schematically illustrating an inkjet circulation apparatus in a non-printing area according to still another embodiment.

Referring to FIG. 5, the inkjet circulation apparatus 103 may include an inkjet printer PR, a collector 140, a storage container 150, a contact member 141, a mixing container 160, a recycling apparatus 200*a*, and the like. However, the inkjet circulation apparatus 103 of FIG. 5 may be substantially identical or similar to the inkjet circulation apparatus 102 shown in FIG. 4 except that the inkjet circulation apparatus 103 further includes a recycling apparatus 200*a*. Hereinafter, the recycling apparatus 200*a* will be mainly described.

In an embodiment, the recycling apparatus 200*a* may be connected to the fourth outlet 162 of the mixing container 160.

In an embodiment, the recycling apparatus 200*a* may be substantially identical or similar to the inkjet printer PR. In other words, the recycling apparatus 200*a* may include a recycling supplier 210, a recycling discharger 230*a*, and a recycling drain 220. The recycling discharger 230*a* may include an inkjet print head. For example, the inkjet print head may be a thermal inkjet print head or a piezo inkjet print head. Accordingly, a display panel may be manufactured or a damaged display panel may be repaired by discharging the ink 300 through the inkjet print head.

Figure 6:
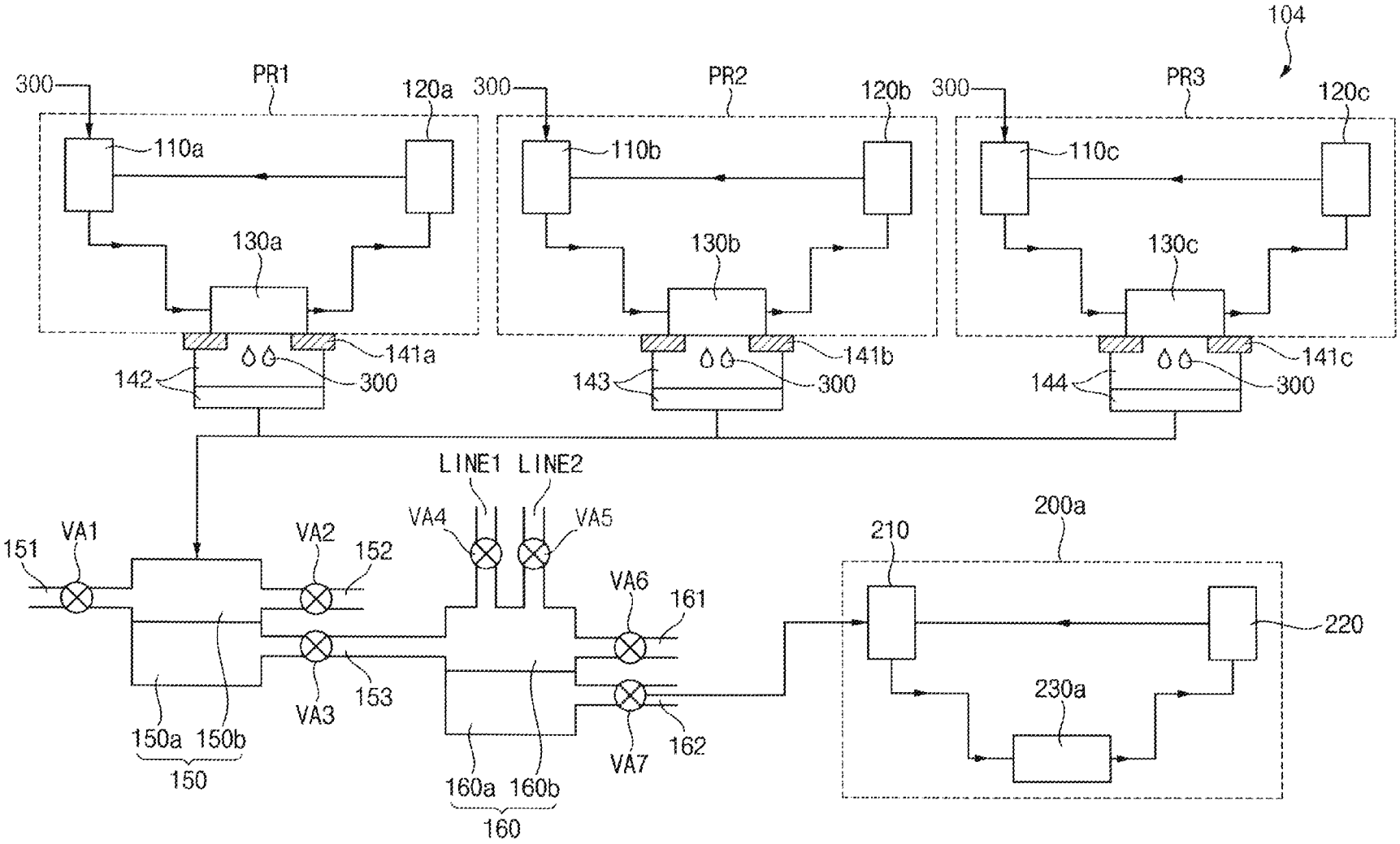
FIG. 6 is a diagram schematically illustrating an inkjet circulation apparatus in a non-printing area according to still another embodiment.

FIG. 6 is a diagram schematically illustrating an inkjet circulation apparatus in a non-printing area according to still another embodiment.

Referring to FIG. 6, the inkjet circulation apparatus 104 may include first to third inkjet printers PR1, PR2, and PR3, first to third collectors 142, 143, and 144, a storage container 150, first to third contact members 141*a*, 141*b*, and 141*c*, a mixing container 160, a recycling apparatus 200*a*, and the like. However, the inkjet circulation apparatus 104 of FIG. 6 may be substantially identical or similar to the inkjet circulation apparatus 103 shown in FIG. 5 except for the number of the inkjet printers PR1, PR2, PR3, the collectors 142, 143, and 144, and the contact members 141*a*, 141*b*, and 141*c*. Hereinafter, the inkjet printers PR1, PR2, and PR3, the collectors 142, 143, and 144, and the contact members 141*a*, 141*b*, and 141*c* will be mainly described.

The first inkjet printer PR1 may include a first supplier 110*a*, a first discharger 130*a*, and a first drain 120*a*, the second inkjet printer PR2 may include a second supplier 110*b*, a second discharger 130*b* and a second drain 120*b*, and the third inkjet printer PR3 may include a third supplier 110*c*, a third discharger 130*c*, and a third drain 120*c*. Accordingly, the inkjet circulation apparatus 104 may store a larger amount of the ink 300.

The contact members 141*a*, 141*b*, and 141*c* may completely seal between the dischargers 130*a*, 130*b*, and 130*c* and the collectors 142, 143, and 144 of the inkjet printers PR1, PR2, and PR3. In other words, the contact members 141*a*, 141*b*, and 141*c* may be disposed between the dischargers 130*a*, 130*b*, 130*c* and the collectors 142, 143, and 144, and be in contact with the dischargers 130*a*, 130*b*, and 130*c* and the collectors 142, 143, and 144. The collectors 142, 143, and 144 may be connected to the storage container 150, respectively. Accordingly, the ink 300 in the collection portions 142, 143, and 144 may be injected into the storage container 150.

The ink 300 may include at least one of red ink, green ink, and white ink. At least one of the red ink, the green ink, and the white ink may be injected into each of the inkjet printers PR1, PR2, and PR3. For example, the red ink may be injected into each of the inkjet printers PR1, PR2, and PR3. As another example, the green ink may be injected into each of the inkjet printers PR1, PR2, and PR3. As another example, the white ink may be injected into each of the inkjet printers PR1, PR2, and PR3.

Figure 7:
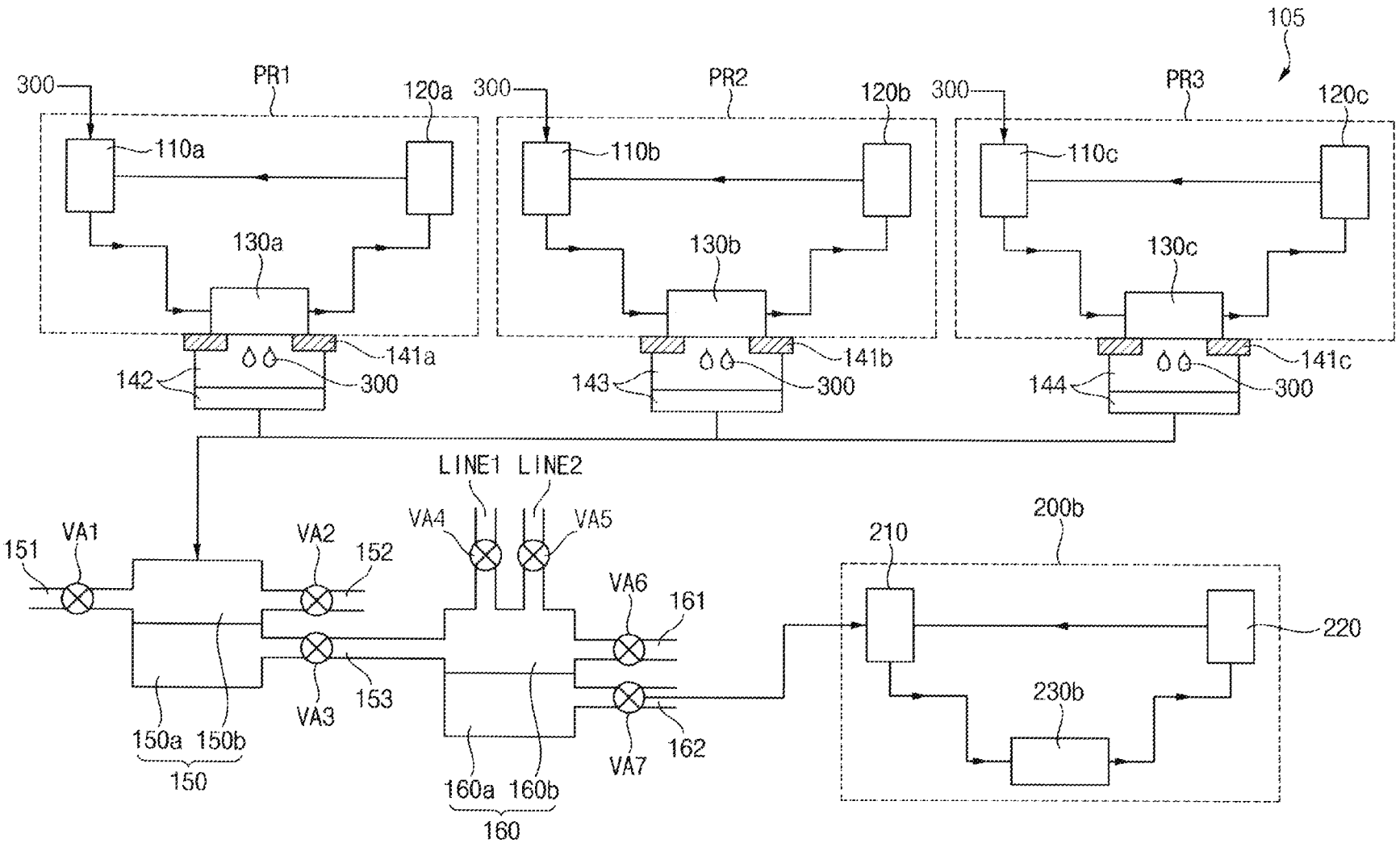
FIG. 7 is a diagram schematically illustrating an inkjet circulation apparatus in a non-printing area according to still another embodiment.

FIG. 7 is a diagram schematically illustrating an inkjet circulation apparatus in a non-printing area according to still another embodiment.

Referring to FIG. 7, the inkjet circulation apparatus 105 may include first to third inkjet printers PR1, PR2, and PR3, first to third collectors 142, 143, and 144, a storage container 150, first to third contact members 141*a*, 141*b*, and 141*c*, a mixing container 160, a recycling apparatus 200*b*, and the like. However, the inkjet circulation apparatus 105 of FIG. 7 may be substantially identical or similar to the inkjet circulation apparatus 104 shown in FIG. 6 except for the recycling discharger 230*b* included in the recycling apparatus 200*b*. Hereinafter, the recycling discharger 230*b* included in the recycling apparatus 200*b* will be mainly described.

The recycling apparatus 200*b* may include a recycling supplier 210, a recycling drain 220, and a recycling discharger 230*b*. In an embodiment, the recycling discharger 230*b* may include an inkjet print head. For example, the inkjet print head may be a thermal inkjet print head or a piezo inkjet print head.

In an embodiment, the recycling discharger 230*b* may include any one of a spray nozzle, a syringe, and a slit. In other words, the recycling discharger 230*b* does not include the inkjet print head, but may include at least one of the jet nozzle, the syringe, and the slit.

Although the mixing container 160 illustrated in FIGS. 4, 5, 6, and 7 is described as including a first pipe LINE1 and a second pipe LINE2, the mixing container 160 may include three or more pipes.

The inkjet circulation apparatus 104 and 105 shown in FIGS. 6 and 7 is described as including the first to third inkjet printers PR1, PR2, and PR3, the first to third collectors 142, 143, and 144, and the first to third contact members 141*a*, 141*b*, and 141*c*, but the inkjet circulation apparatus 104, and 105 may include two or four or more inkjet printers, two or four or more collectors, and two or four or more contact members.

The disclosure may be applied to various display devices including a display device. For example, the invention may be applicable to numerous display devices such as display devices for vehicles, ships and aircrafts, portable communication devices, display devices for exhibition or information transfer, medical display devices, and the like.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the disclosure. Accordingly, all such modifications are intended to be included within the scope of the disclosure. Therefore, it is to be understood that the foregoing is illustrative of various embodiments and is not to be construed as limited to the specific embodiments disclosed, and that modifications to the disclosed embodiments, as well as other embodiments, are intended to be included within the scope of the disclosure.

What is claimed is:

1. An inkjet circulation apparatus comprising:

at least one inkjet printer including:

a supplier into which an ink is injected;

a discharger connected to the supplier and discharging the ink injected from the supplier; and a drain connected to the discharger and the supplier and injecting the ink in the discharger into the supplier;

at least one collector capable of containing an inert gas and the ink discharged from the discharger; and a contact member sealing between the discharger and the collector.

2. The inkjet circulation apparatus of claim 1, wherein each of the at least one inkjet printer and the at least one collector includes a plurality of inkjet printers and a plurality of collectors, respectively.

3. The inkjet circulation apparatus of claim 1, further comprising:

a storage container connected to the collector and being capable of containing the inert gas and the ink injected from the collector.

4. The inkjet circulation apparatus of claim 3, wherein the storage container includes a stirrer for mixing the ink.

5. The inkjet circulation apparatus of claim 3, wherein the storage container includes:

a first outlet through which the inert gas is discharged; and a second outlet through which the ink in the storage container is discharged.

6. The inkjet circulation apparatus of claim 5, wherein the second outlet is connected to the supplier of the inkjet printer and injects the ink into the supplier.

7. The inkjet circulation apparatus of claim 5, further comprising:

a mixing container connected to the second outlet of the storage container and being capable of containing the inert gas and the ink injected from the storage container.

8. The inkjet circulation apparatus of claim 7, wherein the mixing container includes a stirrer for mixing the ink.

9. The inkjet circulation apparatus of claim 7, wherein the mixing container includes:

a third outlet through which the inert gas is discharged;

a fourth outlet through which the ink in the mixing container is discharged; and at least one pipe for injecting an additive into the mixing container.

10. The inkjet circulation apparatus of claim 9, wherein the at least one pipe includes a plurality of pipes.

11. The inkjet circulation apparatus of claim 9, wherein the additive includes at least one of a dispersant and a surfactant.

12. The inkjet circulation apparatus of claim 9, wherein the fourth outlet of the mixing container is connected to the supplier of the inkjet printer and injects the ink into the supplier.

13. The inkjet circulation apparatus of claim 9, further comprising:

a recycling apparatus connected to the fourth outlet of the mixing container, and discharging the ink discharged from the fourth outlet.

14. The inkjet circulation apparatus of claim 13, wherein the recycling apparatus includes:

a recycling supplier connected to the fourth outlet of the mixing container, the ink discharged from the mixing container being injected into the recycling supplier;

a recycling discharger connected to the recycling supplier and discharging the ink injected from the recycling supplier; and a recycling drain connected to the recycling supplier and the recycling discharger, and injecting the ink in the recycling discharger to the recycling supplier.

15. The inkjet circulation apparatus of claim 14, wherein the recycling discharger includes an inkjet print head.

16. The inkjet circulation apparatus of claim 15, wherein the inkjet print head is a thermal inkjet print head or a piezo inkjet print head.

17. The inkjet circulation apparatus of claim 15, wherein the recycling discharger includes at least one of a jet nozzle, a syringe, and a slit.

18. The inkjet circulation apparatus of claim 1, wherein the inert gas includes at least one of nitrogen ($N_2$), argon (Ar), helium (He), and neon (Ne).

19. The inkjet circulation apparatus of claim 1, wherein the contact member includes a soft material.

20. The inkjet circulation apparatus of claim 19, wherein the contact member includes at least one of a silicone and a polymer material.

* * * * *